United States Patent [19]

Polli

[11] Patent Number: 4,896,400

[45] Date of Patent: Jan. 30, 1990

[54] METHOD AND APPARATUS FOR PROCESSING TEXTILE FIBERS IN PARTICULAR COTTON FIBERS IN PRESSED BALES FOR REMOVING THEREFROM ADHERING ORGANIC WASTE RELEASED BY INSECTS

[76] Inventor: Edoardo Polli, via Petrarca, 20—20123 Milano, Italy

[21] Appl. No.: 221,317

[22] Filed: Jul. 19, 1988

[30] Foreign Application Priority Data

Jul. 21, 1987 [IT] Italy ..... 21377 A/87

[51] Int. Cl.[4] ..... D01B 1/48

[52] U.S. Cl. ..... 19/0.27

[58] Field of Search ..... 19/0.27, 66 CC, 66 R; 34/1, 4, 18

[56] References Cited

U.S. PATENT DOCUMENTS 4,128,947 12/1978 Jackson ..... 34/18
4,405,850 9/1983 Edgar ..... 34/1
4,468,865 9/1984 Inagaki ..... 34/1
4,640,020 2/1987 Wear et al. ..... 34/1

*Primary Examiner*—Werner H. Schroeder
*Assistant Examiner*—D. Price
*Attorney, Agent, or Firm*—Bucknam and Archer

[57] ABSTRACT

The present invention relates to a method and apparatus for processing textile fibers, in particular pressed bale cotton fibers, for removing therefrom possible adhering organic waste released by insects, which method comprises the step of processing in a microwave oven, by a substantially continuous cycle, the cotton bales by means of microwaves having given frequency and power, so as to dry the organic waste in such a way that the organic waste can be easily removed from the single fibers by a simple beating treatment.

The apparatus substantially comprises a microwave processing tunnel thereto the cotton bales are supplied, in succession, by means of a loading conveyor belt, a plurality of microwave generating units arranged in said tunnel and a discharging conveyor belt for unloading the microwave processed cotton bales.

7 Claims, 1 Drawing Sheet

METHOD AND APPARATUS FOR PROCESSING TEXTILE FIBERS IN PARTICULAR COTTON FIBERS IN PRESSED BALES FOR REMOVING THEREFROM ADHERING ORGANIC WASTE RELEASED BY INSECTS

BACKGROUND OF THE INVENTION

The present invention relates to a method and apparatus for processing textile fibers, in particular cotton fibers arranged in pressed bales, for removing therefrom possible insect organic waste adhering to the fibers.

As is known, cotton fibers coming from some cotton production regions, such as Sudan, are frequently contaminated by organic waste and/or excrements of insects, mainly the so-called "white fly".

This organic waste substantially consists of a yellowish substance of glue consistency which is usually called "honey dew".

Because of this organic waste, which strongly adheres to the single cotton fibers, the fibers can be hardly processed for making them suitable for possible spinning operations, with a consequent poor yield and a poor quality of the spun fibers.

None process is presently available for easily and fully removing the mentioned organic waste from cotton fibers.

SUMMARY OF THE INVENTION

Accordingly, the task of the present invention is to overcome the above mentioned drawbacks, by providing a method for processing textile fibers, in particular pressed bale cotton fibers adapted for efficiently removing from said fibers, in a quick and easy way, possible adhering organic waste.

Within the scope of this taks, a main object of the present invention is to provide such a method which is adapted to process great amounts of cotton fibers, with a great hourly yield.

Another object of the present invention is to provide such a method which is adapted to efficiently remove the mentioned organic waste without negatively affecting the textile properties of the cotton fibers.

Yet another object of the present invention is to provide such a method which is effective to process cotton fibers arranged in pressed bales having conventional shapes and size.

Yet another object of the present invention is to provide and apparatus for carrying out the above mentioned method which apparatus is very simple construction-wise and can be made starting from easily available materials and components.

According to one aspect of the present invention, the above mentioned task and objects, as well as yet other objects, which will become more apparent hereinafter, are achieved by a method for processing textile fibers, in particular pressed bale cotton fibers, for removing from said fibers organic waste of insects adhering to said fibers, characterized in that said method comprises the steps of:

supplying, with a substantially continuous movement, a plurality of pressed cotton bales to a processing tunnel;

subjecting the present cotton bales in said tunnel to a microwave radiation, or given frequency and power, adapted to fully dry the organic waste adhering to said fibers; and discharging from said tunnel the thus processed cotton bales.

According to a further aspect of the present invention, the pressed cotton bales are subjected, in said tunnel, to a combined action of microwaves and air for cooling the outer surfaces of said bales.

The apparatus for carrying out the above mentioned methos comprises a loading platform, consisting of an endless conveyor belt, thereon the single cotton bales are arranged one after the other.

This loading platform is adapted to convey the pressed cotton bales to a processing tunnel therein there are arranged, with a given predetermined arrangement, a plurality of microwave generating units, adapted to microwave process the individual cotton bales supplied to the tunnel, the microwave processed bales being discharged from the processing tunnel by means of a further output conveyor.

BRIEF DESCRIPTION OF THE DRAWINGS

Further characteristics and advantages of the apparatus and method for processing textile fibers, in particular cotton fibers collected in pressed bales, for removing therefrom adhering organic waste, will become more apparent hereinafter from the following detailed disclosure of a preferred embodiment thereof, which is illustrated, by way of an indicative example, in the figures of the accompanying drawings, in which.

DESCRIPTION OF THE PREFERRED EMBODIMENTS

As mentioned, cotton fibers coming from some cotton producing regions are contaminated by glue type of waste, of an insect called "white fly".

This waste negatively affects the spinning operations of said fibers and the obtained spun yarns have a poor quality, since this waste firmly adhers to the fibers.

The present invention affords the possibility of overcoming or at least reducing the mentioned drawback by subjecting the cotton fibers, preferably arranged in pressed bales, to a microwave processing.

In fact the microwaves, which generate heat inside the overall body of the pressed cotton bale, are effective to completely dry the insect excrements so as to cause said excrements to assume a hard crystalline consistency which will facilitate the detaching thereof, such as by simple beating operations.

Thus, the cotton fibers can be spun easily and will provide a cotton yarn having very good properties.

Moreover it has been found that the microwave processing does not alter the textile characteristics of the cotton fibers, since it exclusively affects the contaminating substances or organic waste.

For carrying out the method according to the present invention, several types of microwave generators have been tested and it has been found that very good results were obtained by using microwave generators or sources adapted to provide microwave beams having a frequency of substantially 2,450 MHz, with microwave powers from 0.3 to 20 KW.

Figure 1:
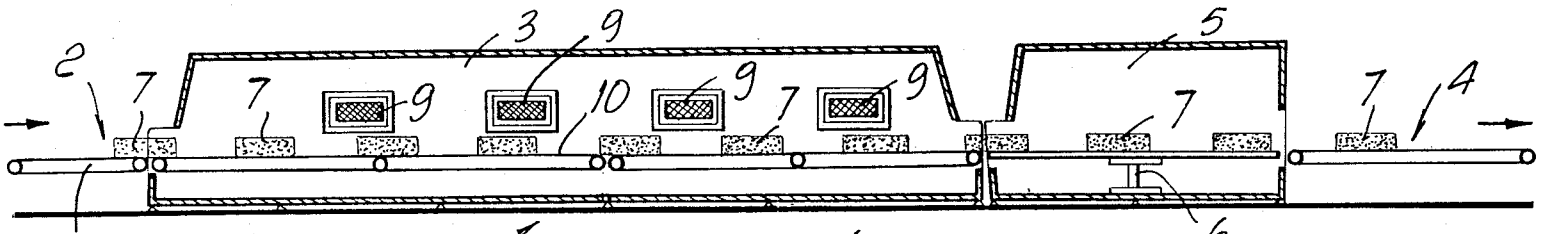
FIG. 1 is a partially sectioned front view of an apparatus for carrying out the method according to the present invention.
Figure 2:
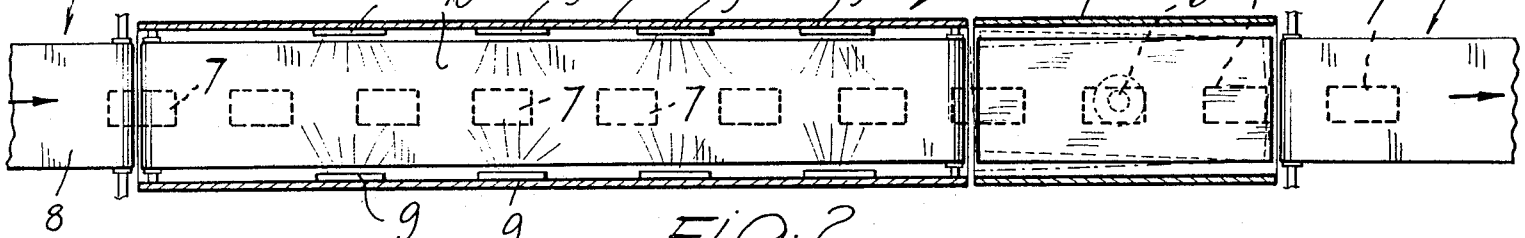
FIG. 2 is a top view of the apparatus shown in FIG. 1.
Figure 3:
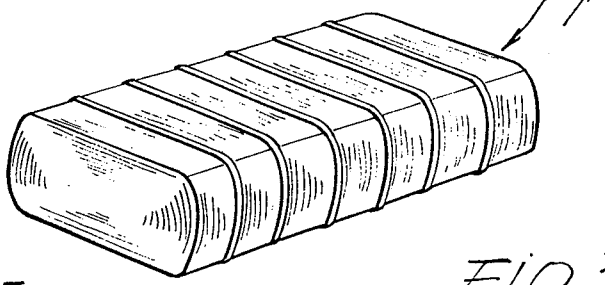
FIG. 3 shows a cotton bale which can be processed by means of the method and apparatus according to the present invention.

With reference to FIG. 1, there is shown a possible embodiment of an apparatus for carrying out the method according to the invention, which has been briefly disclosed thereinabove, said apparatus being indicated overally at the reference number 1.

As is shown, this apparatus essentially comprises three main components and, more specifically, a loading conveyor belt assembly 2, a processing tunnel 3 and a discharging conveyor belt assembly 4.

The single cotton bales, indicated overally at the reference number 7 are supplied in succession, one after the other, or in parallel rows, through the loading gate 8 in the direction of the arrow to the inlet of the tunnel 3 and enter said tunnel, in the inside of which there are arranged a plurality of microwave generating units or sources, indicated at the reference number 9.

These generating units are arranged in such a way as to cover a broad radiating region, so as to cover all of the zone therethrough the pressed cotton bales will pass.

As discussed, inside said tunnel 3 air generating units can also be arranged, which have not been specifically shown, in order to accelerate the drying process of the excrements adhering to the cotton fibers of said bales.

In an effectively constructed system, the loading assembly was designed for supporting 30 bales and it operated as a dampening element at the output of the microwave generating units.

This loading assembly, in particular, included a bearing or supporting frame with related fittings of stainless steel for a dampening chamber and its size was of 15, 000×2,000×1,100 mm.

The microwave heating tunnel 3 consisted of an inner strip conveyor belt which, in the drawings has been indicated at the reference number 10, with polytetrafluoroethylene (PTFE) supporting elements, one of which has been indicated at 6, of the reinforced and low loss coefficient type for preventing them from being excessively heated.

The bearing framework of the heating tunnel or oven was made of AISI 304 stainless steel and defined a multimode microwave heating chamber; the oven further included a forced air cooling assembly 25.

The microwave generating assembly, which represent the core of the method and apparatus according to the present invention, was formed, in the disclosed embodiment, by ten microwave generating units or sources adapted to generate microwaves having a frequency of 2, 450 MHz, of the 1540/03 MW type, providing a variable microwave power from 300 to 1, 100 W, and ten generators of the 1540/01 type with a microwave power of 1,200 W (a fixed power) with a supply voltage or 220 V and a frequency of 50 Hz.

The single microwave generators were designed either for manual control or for computer control(not specifically shown).

The apparatus also included a discharging conveyor belt, of the strip type, having substantially the same characteristics as the loading conveyor belt.

With the disclosed apparatus or system 7,000 Kg per day of cotton fibers have been processed, with a speed of substantially 300 Kg/hour.

The apparatus size was of 42,500×2,400×2,700 mm; in particular the apparatus had a length of 42,500 mm, a useful width of 2,400 mm and a useful height at the inlet of the processing tunnel of 800 mm; the processing tunnel was lined by a thermally insulating mat and means were provided for automatically adjusting the microwave power.

The processed cotton bales were pressed cotton bales, produced in Sudan, and two types of these bales, different for volume, weight and density were processed.

More specifically, the first processed bale type had a volume of 0.553 $M^3$, a weight of 185 kg and a density of 334.5 $kg/m^3$; the second type had a volume of 0.705 $m^3$, a weight of 220 Kg and a density of 312 $kg/m^3$.

In both the processing examples the moisture of the pressed cotton bales had a value of about 6%.

The above discussed cotton bales types are fully standard types and have been shown in order to demonstrate that the method according to the present invention can be directly applied to conventional cotton bales without any preprocessing of said bales.

Figure 5:
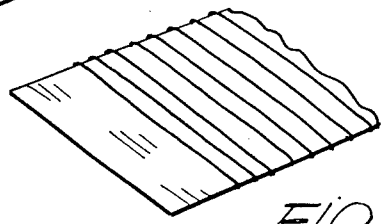
FIG. 5 shows some cotton yarns spun from cotton fibers processed by the method and apparatus according to the present invention
Figure 4:
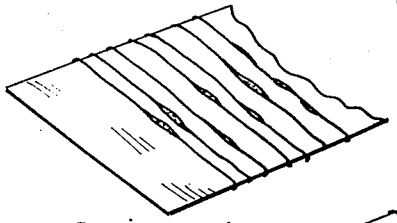
FIG. 4 shows cotton yarns spun from not processed cotton fibers, according to the prior art.

The cotton bales processed by the method and apparatus according to the present invention were fed to a conventional beating working step. It has been found that the excrements were well dried and immediately detached from the cotton fibers, which could be easily spun, providing cotton yarns having very good properties, as is shown in FIG. 5, contrarily from the yarns produced by the same cotton fibers but not processed by the inventive method, as shown in FIG. 4.

From the above discussion it should be apparent that the invention fully achieves the intended task and objects.

While the invention has been disclosed and illustrated with reference to a preferred embodiment thereof, it should be apparent that the disclosed embodiment is susceptible to several modifications and variations within its scope.

I claim:

1. A method for processing textile fibers, in particular pressed cotton bales for removing from said textile fibers insect excrements wherein said method comprises the steps of:

supplying, in a substantially continuous way, a plurality of pressed cotton bales to a processing tunnel, irradiating said pressed cotton bales in said tunnel by microwaves having set frequency and power, said microwaves being adapted to dry said excrements, and removing from said tunnel the thus processed cotton bales.

2. A method according to claim 1, wherein said method further comprises the step of subjecting said pressed cotton bales in said tunnel to a combined action of said microwaves and drying air.

3. A method according to claim 1, wherein said method further comprises the step of subjecting said pressed cotton bales removed from said tunnel to a beating process.

4. A method according to claim 1, wherein said method comprises a further step of subjecting said microwave irradiated cotton bales to an air cooling step.

5. A method according to claim 1, wherein said set frequency of said microwaves is included in the frequency range of 500–4,500 MHz.

6. A method according to claim 1, wherein said set frequency of said microwaves is of 2,450 MHz.

7. A method according to claim 1, wherein said set power of said microwaves is from several tens to several hundreds of watts.

* * * * *